US010580380B2

(12) United States Patent
Zheng et al.

(10) Patent No.: US 10,580,380 B2
(45) Date of Patent: Mar. 3, 2020

(54) LEVEL CONVERSION CIRCUIT, DISPLAY APPARATUS, AND DRIVING METHOD

(71) Applicants: BOE Technology Group Co., Ltd., Beijing (CN); HEFEI BOE OPTOELECTRONICS TECHNOLOGY CO., LTD., Anhui (CN)

(72) Inventors: Liangliang Zheng, Beijing (CN); Tingting Jin, Beijing (CN)

(73) Assignees: BOE TECHNOLOGY GROUP CO., LTD., Beijing (CN); HEFEI BOE OPTOELECTRONICS TECHNOLOGY CO., LTD., Anhui (CN)

( * ) Notice: Subject to any disclaimer, the term of this patent is extended or adjusted under 35 U.S.C. 154(b) by 0 days.

(21) Appl. No.: 16/066,795

(22) PCT Filed: Dec. 4, 2017

(86) PCT No.: PCT/CN2017/114429
§ 371 (c)(1),
(2) Date: Jun. 28, 2018

(87) PCT Pub. No.: WO2018/188357
PCT Pub. Date: Oct. 18, 2018

(65) Prior Publication Data

US 2019/0266972 A1 Aug. 29, 2019

(30) Foreign Application Priority Data

Apr. 10, 2017 (CN) ..... 2017 1 0227973

(51) Int. Cl.
*G09G 3/36* (2006.01)

(52) U.S. Cl.
CPC ..... *G09G 3/3677* (2013.01); *G09G 3/36* (2013.01); *G09G 3/3696* (2013.01); *G09G 2310/0286* (2013.01)

(58) Field of Classification Search
CPC ..... G09G 2310/0286; G09G 3/3677; G09G 2310/0289
See application file for complete search history.

(56) References Cited

U.S. PATENT DOCUMENTS 6,133,756 A 10/2000 Kitao
9,583,059 B2 2/2017 Zheng et al.
(Continued)

FOREIGN PATENT DOCUMENTS

CN 1233110 A 10/1999
CN 1838221 A 9/2006
(Continued)

OTHER PUBLICATIONS

International Search Report and Written Opinion for International Application No. PCT/CN2017/114429, dated Mar. 7, 2018, including English translation of Search Report and Box V of Written Opinion, 14 pages.
(Continued)

*Primary Examiner* — Koosha Sharifi-Tafreshi
(74) *Attorney, Agent, or Firm* — Westman, Champlin & Koehler, P.A.

(57) ABSTRACT

The present disclosure provides a level conversion circuit, a display apparatus, and a driving method. The level conversion circuit includes a level conversion sub-circuit, a power supply switch sub-circuit, and a controller. The level conversion sub-circuit is connected to a first input terminal, the power supply switch sub-circuit, and an output terminal, respectively, and is configured to receive a first signal, receive a first driving level from the power supply switch
(Continued)

sub-circuit, convert the received first signal into the first driving level, and output the first driving level to the output terminal. The power supply switch sub-circuit is further connected to the controller and is configured to receive N candidate first levels, receive a control signal from the controller, select one of the N candidate first levels as the first driving level according to the received control signal, and output the selected first driving level to the level conversion sub-circuit, where N is an integer greater than or equal to 2.

15 Claims, 5 Drawing Sheets

(56) References Cited

U.S. PATENT DOCUMENTS

2007/0296682 A1 12/2007 Hwang
2008/0136809 A1* 6/2008 Lee ..... G09G 3/3677 345/214
2008/0211760 A1* 9/2008 Baek ..... G09G 3/3677 345/98

FOREIGN PATENT DOCUMENTS

| | | | |
|---|---|---|---|
| CN | 101060310 | A | 10/2007 |
| CN | 101093649 | A | 12/2007 |
| CN | 103489425 | A | 1/2014 |
| JP | H08-320674 | A | 12/1996 |

OTHER PUBLICATIONS

Office Action, including Search Report, for Chinese Patent Application No. 201710227973.2, dated Apr. 19, 2019, 17 pages.
English translation of the Abstract for CN101093649A, previously cited in the PTO-1449 submitted Dec. 19, 2018, 1 page.
English translation of the Abstract for CN1838221A, previously cited in the PTO-1449 submitted Dec. 19, 2018, 1 page.
English translation of the Abstract for JPH098320674A, previously cited in the PTO-1449 submitted Dec. 19, 2018, 1 page.

* cited by examiner

LEVEL CONVERSION CIRCUIT, DISPLAY APPARATUS, AND DRIVING METHOD

CROSS-REFERENCE TO RELATED APPLICATION(S)

This application is a U.S. National Stage Application of PCT Application No. PCT/CN2017/114429, filed on Dec. 4, 2017, entitled "LEVEL CONVERSION CIRCUIT, DISPLAY APPARATUS, AND DRIVING METHOD", which claims priority to the Chinese Patent Application No. 201710227973.2, filed on Apr. 10, 2017, entitled "LEVEL CONVERSION CIRCUIT, DISPLAY APPARATUS, AND DRIVING METHOD", which are incorporated herein by reference in their entireties.

TECHNICAL FIELD

The present disclosure relates to the field of display technology, and more particularly, to a level conversion circuit, a display apparatus and a driving method.

BACKGROUND

In recent years, with the rapid development of semiconductor technology, portable electronic products and flat panel display products have also emerged. Thin film transistor (TFT) liquid crystal displays have become standard output devices for various data products because of their advantages such as low operating voltage, no radiation scattering, light weight, small size etc. A thin film transistor liquid crystal display is generally composed of a matrix of pixels arranged in both a horizontal direction and a vertical direction. When the thin film transistor liquid crystal display performs display, it needs to generate a gate input signal and sequentially scan various rows of pixels from a first row to a last row. In the thin film transistor liquid crystal display, this is done by an appropriate gate driver. In general, the gate driver is composed of a plurality of stages of shift registers connected in series, wherein an output signal of a previous stage of shift register is used as an input signal of a next stage of shift register.

In order to reduce the production cost of the thin film transistor liquid crystal display, manufacturers in the industry manufacture multiple stages of amorphous silicon shift registers and a gate driving circuit (i.e., a GOA driving circuit) directly on a glass substrate of a panel by using an amorphous silicon process to replace a gate driver in the related art, so as to reduce the production cost of the liquid crystal display.

In the GOA driving circuit, a simple group of frame start signals STV and a clock control signal CLK are input, a gate signal is transmitted stage by stage through a cascaded circuit on the panel, and the STV and CLK signals have the same output levels. However, in practice, due to the difference in resistances of fan-out areas of panels of thin film transistors and the difference in process characteristics of the panels, it is easy to cause a difference in charging voltages of different rows, and thereby a vertical line defect due to insufficient charging occurs on the panel.

SUMMARY

The present disclosure proposes a level conversion circuit, a display apparatus, and a driving method.

According to an aspect of the present disclosure, there is proposed a display apparatus. The display apparatus comprises: a plurality of pixels; a plurality of shift registers, each shift register being connected to at least one pixel and configured to provide a scanning signal to the at least one pixel; and a level conversion circuit connected to the plurality of shift registers, and configured to provide a first driving signal and a second driving signal which are independent of each other to a first shift register and a second shift register of the plurality of shift registers, respectively.

In some embodiments, the plurality of pixels are divided into a plurality of groups of pixels in rows or columns, pixels in each group of pixels are connected to the same gate driving circuit, each gate driving circuit is formed by cascading at least one of the plurality of shift registers, and the first shift register and the second shift register belong to different gate driving circuits respectively.

In some embodiments, the plurality of pixels are divided into two groups in rows, which are a group of odd-numbered rows of pixels and a group of even-numbered rows of pixels, and the level conversion circuit is configured to provide driving signals which are independent of each other to the group of odd-numbered rows of pixels and the group of even-numbered rows of pixels respectively.

In some embodiments, the first driving signal and/or the second driving signal are frame start signals and/or clock control signals.

In some embodiments, the level conversion circuit comprises a level conversion sub-circuit, a power supply switch sub-circuit and a controller, wherein the level conversion sub-circuit is connected to the power supply switch sub-circuit and is configured to receive a first signal from a first input terminal of the level conversion circuit, receive a first driving level from the power supply switch sub-circuit, convert the received first signal into the first driving level, and output the first driving level to a corresponding shift register connected to the level conversion circuit through an output terminal of the level conversion circuit; and the power supply switch sub-circuit is further connected to the controller and is configured to receive N candidate first levels, receive a control signal from the controller, select one of the N candidate first levels as the first driving level according to the received control signal, and output the selected first level to the level conversion sub-circuit, where N is an integer greater than or equal to 2.

In some embodiments, the level conversion sub-circuit is further configured to receive a second driving level from the power supply switch sub-circuit, convert the received first signal to a second driving level, and output the second driving level; and the power supply switch sub-circuit is further configured to receive N candidate second levels, select one of the N candidate second levels as the second driving level according to the received control signal, and output the selected second level to the level conversion sub-circuit, wherein the first driving level is different from the second driving level.

In some embodiments, the N candidate first levels are in a one-to-one correspondence with the N candidate second levels, and the power supply switch sub-circuit selects a candidate first level and a candidate second level which correspond to each other based on the control signal.

In some embodiments, the power supply switch sub-circuit comprises N first transistors, each first transistor being connected to a candidate first level input terminal, wherein each first transistor has a source configured to input a corresponding candidate first level, a gate connected to the controller and controlled by the control signal, and a drain connected to the level conversion sub-circuit and configured to output the corresponding candidate first level to the level conversion sub-circuit as the first driving level when the first transistor is turned on.

In some embodiments, the power supply switch sub-circuit comprises N second transistors, each second transistor corresponding to a candidate second level, wherein each second transistor has a source connected to a corresponding candidate second level, a gate connected to the controller and controlled by the control signal, and a drain connected to the level conversion sub-circuit and configured to output the corresponding candidate second level to the level conversion sub-circuit as the second driving level when the second transistor is turned on.

According to another aspect of the present disclosure, there is provided a level conversion circuit. The level conversion circuit comprises a level conversion sub-circuit, a power supply switch sub-circuit and a controller, wherein the level conversion sub-circuit is connected to a first input terminal, the power supply switch sub-circuit and an output terminal respectively, and is configured to receive a first signal from the first input terminal, receive a first driving level from the power supply switch sub-circuit, convert the received first signal into the first driving level, and output the first driving level to the output terminal; and the power supply switch sub-circuit is further connected to the controller and is configured to receive N candidate first levels, receive a control signal from the controller, select one of the N candidate first levels as the first driving level according to the received control signal, and output the selected first level to the level conversion sub-circuit, where N is an integer greater than or equal to 2.

According to yet another aspect of the present disclosure, there is provided a method for driving the level conversion circuit described above. The method comprises: outputting, by the power supply switch sub-circuit, one of the N candidate first levels as the first driving level based on the control signal; and outputting, by the level conversion sub-circuit, an output level equal to the first driving level when the first signal at a high level is received.

In some embodiments, the power supply switch sub-circuit of the level conversion circuit is further configured to receive N candidate second levels, select one of the N candidate second levels as the second driving level according to the received control signal, and output the selected second level to the level conversion sub-circuit, wherein the first driving level is different from the second driving level, the method further comprising: outputting, by the power supply switch sub-circuit, one of the N candidate second levels as the second driving level based on the control signal; and outputting, by the level conversion sub-circuit, an output level equal to the second driving level when the first signal at a low level is received.

According to yet another aspect of the present disclosure, there is provided a method for driving the display apparatus described above. The method comprises: generating a control signal according to an actual gate driving voltage of a thin film transistor which controls switching of a pixel; and generating, by the level conversion circuit, driving signals corresponding to a plurality of shift registers respectively according to the control signal, wherein a first driving signal and a second driving signal corresponding to a first shift register and a second shift register of the plurality of shift registers respectively are independent of each other.

In some embodiments, generating, by the level conversion circuit, driving signals corresponding to a plurality of shift registers respectively according to the control signal comprises: switching the first driving level output by the power supply switch sub-circuit of the level conversion circuit to a candidate first level corresponding to the actual gate driving voltage according to the control signal; and outputting, by the level conversion sub-circuit of the level conversion circuit, the candidate first level as a driving signal for driving a corresponding shift register.

In some embodiments, generating, by the level conversion circuit, driving signals corresponding to a plurality of shift registers respectively according to the control signal comprises: switching the second driving level output by the power supply switch sub-circuit of the level conversion circuit to a candidate second level corresponding to the actual gate driving voltage according to the control signal; and outputting, by the level conversion sub-circuit of the level conversion circuit, the candidate second level as a driving signal for driving a corresponding shift register.

DETAILED DESCRIPTION

Specific embodiments of the present disclosure will be described in detail below. It should be noted that the embodiments described here are illustrated merely by way of example instead of limiting the present disclosure. In the following description, numerous specific details are set forth to provide a more thorough understanding of the present disclosure. However, it will be obvious to those skilled in the art that the present disclosure may be practiced without these specific details. In other instances, well-known circuits, materials or methods are not described in detail in order to avoid obscuring the present disclosure.

Reference throughout this specification to "one embodiment", "an embodiment", "one example" or "an example" means that a particular feature, structure, or characteristic described in connection with the embodiment or example is included in at least one embodiment of the present invention. Thus, the appearances of the phrase "in one embodiment", "in an embodiment", "one example" or "an example" in various places throughout this specification are not necessarily all referring to the same embodiment or example.

Furthermore, the particular features, structures, or characteristics may be combined in any suitable combination and/or sub-combination in one or more embodiments or examples. In addition, those skilled in the art should understand that the accompanying drawings provided herein are for the purpose of illustration, and are not necessarily drawn to scale. A term "and/or" used herein comprises any or all combinations of one or more listed related items.

The present disclosure will be specifically described below with reference to the accompanying drawings.

Figure 1:
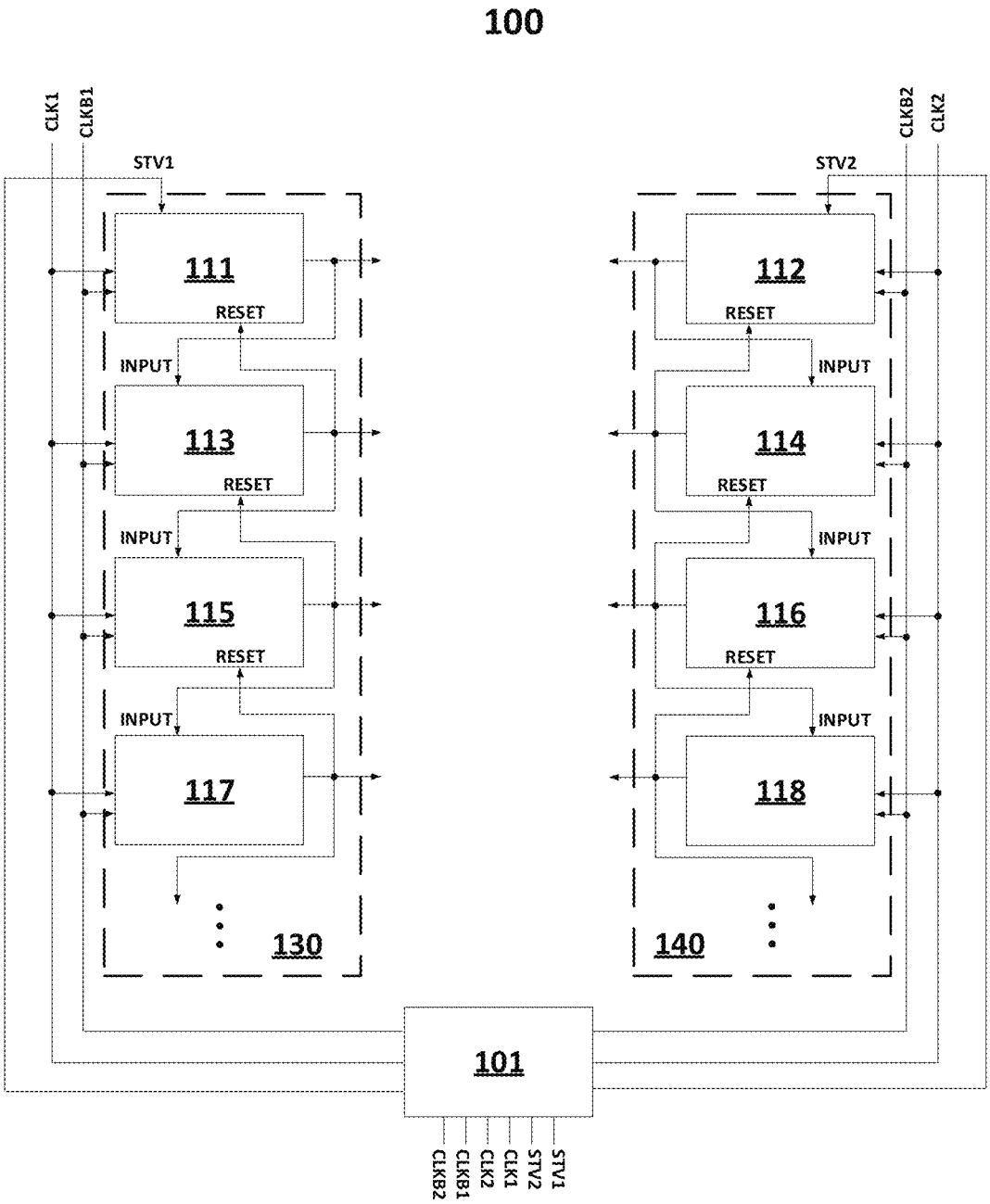
FIG. 1 illustrates a cascaded diagram of a GOA driving circuit according to an embodiment of the present disclosure.

Firstly, FIG. 1 illustrates a cascade diagram of a GOA driving circuit 100 according to an embodiment of the present disclosure. The GOA driving circuit 100 comprises a plurality of shift registers 111-118 and a level conversion circuit 101. As can be seen from FIG. 1, odd-numbered shift registers (shift register 111, shift register 113, shift register 115, shift register 117, etc.) and even-numbered shift registers (shift register 112, shift register 114, shift register 116, shift register 118, etc.) are cascaded on both sides of a display panel, respectively, which drive odd-numbered rows of pixels and even-numbered rows of pixels respectively. Frame start signals STV1 and STV2 are input to the shift register 111 and the shift register 112 respectively. Clock signal lines CLK1 and CLKB1 provide clock signals to the odd-numbered rows of shift registers, and clocks signal lines CLK2 and CLKB2 provide clock signals to the even-numbered rows of shift registers. Level conversion is firstly performed on STV1, STV2, CLK1, CLK2, CLKB1, and CLKB2 through the level conversion circuit 101 before being input to various shift registers.

In addition, although the shift registers 111 to 118 are shown in the embodiment illustrated in FIG. 1 as being divided into a group of odd-numbered rows on the left side and a group of even-numbered rows on the right side, the present disclosure is not limited thereto. In fact, a plurality of pixels may be divided into a plurality of groups of pixels in rows or columns, and pixels in each group of pixels may be connected to the same gate driving circuit (for example, a gate driving circuit 130 or 140). Each of the gate driving circuits (for example, the gate driving circuit 130) is formed by cascading at least one of the above plurality of shift registers (for example, shift registers 111, 113, 115 and 117). In other words, the shift registers may be divided into a plurality of groups, each group of shift registers is cascaded to form a gate driving circuit, and each gate driving circuit is configured to drive corresponding one or more rows or columns of pixels.

Figure 2:
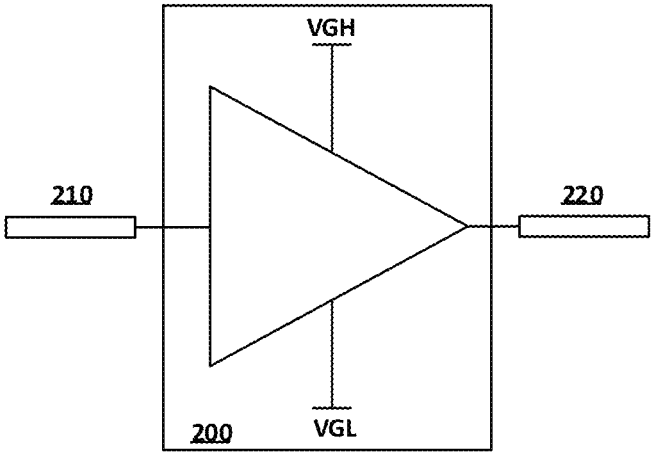
FIG. 2 illustrates a circuit diagram of a level conversion circuit according to an embodiment of the present disclosure.

FIG. 2 illustrates a circuit diagram of a level conversion circuit 200 according to an embodiment of the present disclosure. The level conversion circuit 200 has a signal input terminal configured to receive a first signal (for example, STV1, STV2, CLK1, CLK2, CLKB1, and CLKB2) having an input logic reference level 210 (for example, 3.3V or 1.8V) from a first signal terminal, a first level input terminal configured to input VGH, and a second level input terminal configured to input VGL. The level conversion circuit 200 outputs a second signal 220 equal to VGH or VGL as an output level 220 obtained by converting the first signal 210 (STV1, STV2, CLK1, CLK2, CLKB1, and CLKB2) depending on whether the input logic reference level is a high level or a low level. In another embodiment, the level conversion circuit 200 may further comprise a gate pulse modulation circuit connected between an operational amplifier and an output terminal and configured to implement a so-called "cut angle modulation" function. In an embodiment, the level conversion circuit 200 may be implemented by the operational amplifier. In other embodiments, the level conversion circuit 200 may be implemented using other principles.

Figure 9:
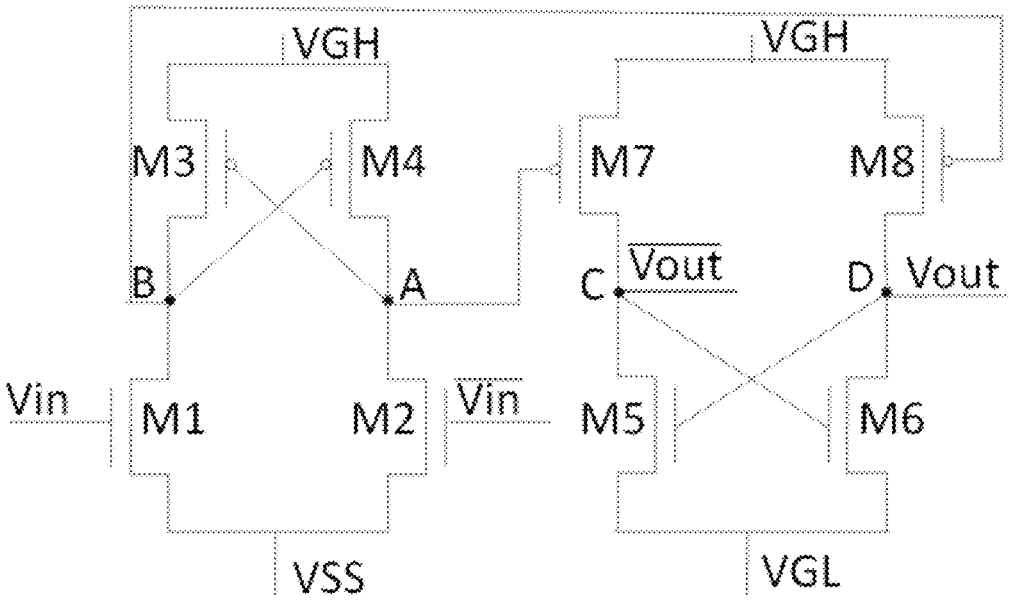
FIG. 9 illustrates an exemplary detailed circuit diagram of the level conversion circuit in FIG. 2.

FIG. 9 illustrates an exemplary structure of the level conversion circuit 200 shown in FIG. 2. The circuit structure comprises a level state transfer unit on the left side of FIG. 9 and a second level driving unit on the right side of FIG. 9. In this circuit structure, Vin is a first signal positive phase input terminal configured to input a positive phase level. $\overline{\text{Vin}}$ is a first signal reverse phase input terminal configured to input a reverse phase level. Inputs of the Vin and $\overline{\text{Vin}}$ correspond to the input logic reference level (i.e., the first signal) in FIG. 2. Vout is a second signal positive phase output terminal configured to output a second positive phase level, and $\overline{\text{Vout}}$ is a second signal reverse phase output terminal configured to output a second reverse phase level. Outputs of Vout and $\overline{\text{Vout}}$ correspond to the converted output level (i.e., the second signal) in FIG. 2. VSS is a low level of the first signal, and VGH and VGL are a high level and a low level of the second signal respectively.

In the level state transfer unit:

a first signal positive phase input unit comprises a first thin film transistor M1. The first thin film transistor M1 has a drain connected to the low level VSS of the first signal, a source connected to a reference node B, and a gate connected to the first signal positive phase input terminal Vin;

a first signal reverse phase input unit comprises a second thin film transistor M2. The second thin film transistor M2 has a drain connected to the low level VSS of the first signal, a source connected to a reference node A, and a gate connected to the first signal reverse phase input terminal $\overline{\text{Vin}}$; and a first state interlocking unit comprises a third thin film transistor M3 and a fourth thin film transistor M4. The third thin film transistor M3 has a gate connected to the reference node A, a drain connected to the reference node B, and a source connected to the high level VGH of the second signal, and the fourth thin film transistor M4 has a gate connected to the reference node B, a drain connected to the reference node A, and a source connected to the high level VGH of the second signal.

In the embodiment shown in FIG. 9, the gate of the first thin film transistor M1 may be used as the first signal positive phase input terminal Vin, and the source of the second thin film transistor M2 may be used as the first level positive phase output terminal, so as to transfer high and low states of an input level to a second level driving sub-circuit. The gate of the second thin film transistor M2 may be used as the first signal reverse phase input terminal $\overline{\text{Vin}}$, and the drain of the fourth thin film transistor M4 may be used as the first level reverse phase output terminal, so as to transfer the high and low states of the input level to the second level driving sub-circuit. The first state interlocking unit composed of the third thin film transistor M3 and the fourth thin film transistor M4 is configured to maintain level states of the first level positive phase output terminal (point A in FIG. 9) and the first level reverse phase output terminal (point B in FIG. 9).

In addition, it should be illustrated that in the embodiment shown in FIG. 9, the transistors M3 and M4 are P-type transistors, and the transistors M1 and M2 are N-type transistors. However, the present disclosure is not limited thereto. In fact, those skilled in the art can design alternative circuits which employ different configurations but achieve the same function according to the embodiment shown in FIG. 9.

In the second level driving unit:

a second signal positive phase input unit comprises a seventh thin film transistor M7. The seventh thin film transistor M7 has a gate connected to the reference node A, a drain connected to a reference node C, and a source connected to the high level VGH of the second signal; and a second signal reverse phase input unit comprises an eighth thin film transistor M8. The eighth thin film transistor M8 has a gate connected to the reference node B, a drain connected to a reference node D, and a source connected to the high level VGH of the second signal.

A second state interlocking unit comprises a fifth thin film transistor M5 and a sixth thin film transistor M6. The fifth thin film transistor M5 has a gate connected to the reference node D, and a source connected to the reference node C, the sixth thin film transistor M6 has a gate connected to the reference node C, and a source connected to the reference node D, and a drain of the fifth thin film transistor M5 and a drain of the sixth thin film transistor M6 are both connected to the low level VGL of the second signal.

In the second level driving unit, the gate of the seventh thin film transistor M7 may be used as a receiving terminal for receiving a level transferred by the reference node A, and the drain of the eighth thin film transistor M8 may be used as the second level positive phase output terminal Vout. The gate of the eighth thin film transistor M8 may be used as a receiving terminal for receiving a level transferred by the reference node B, and the drain of the seventh thin film transistor M7 may be used as the second level reverse phase output terminal $\overline{\text{Vout}}$. The second state interlocking unit composed of the fifth thin film transistor M5 and the sixth thin film transistor M6 may be configured to maintain level states of the second signal positive phase output terminal and the second signal reverse phase output terminal.

In addition, it should also be illustrated that in the embodiment shown in FIG. 9, the transistors M7 and M8 are P-type transistors, and the transistors M5 and M6 are N-type transistors. However, the present disclosure is not limited thereto. In fact, those skilled in the art can design alternative circuits which employ different configurations but achieve the same function according to the embodiment shown in FIG. 9.

It should be understood by those skilled in the art that the circuit structure and implementation principle of the level conversion circuit 200 are not limited to the example shown in FIG. 9, and they can also be implemented by other circuit structures or principles.

Figure 3:
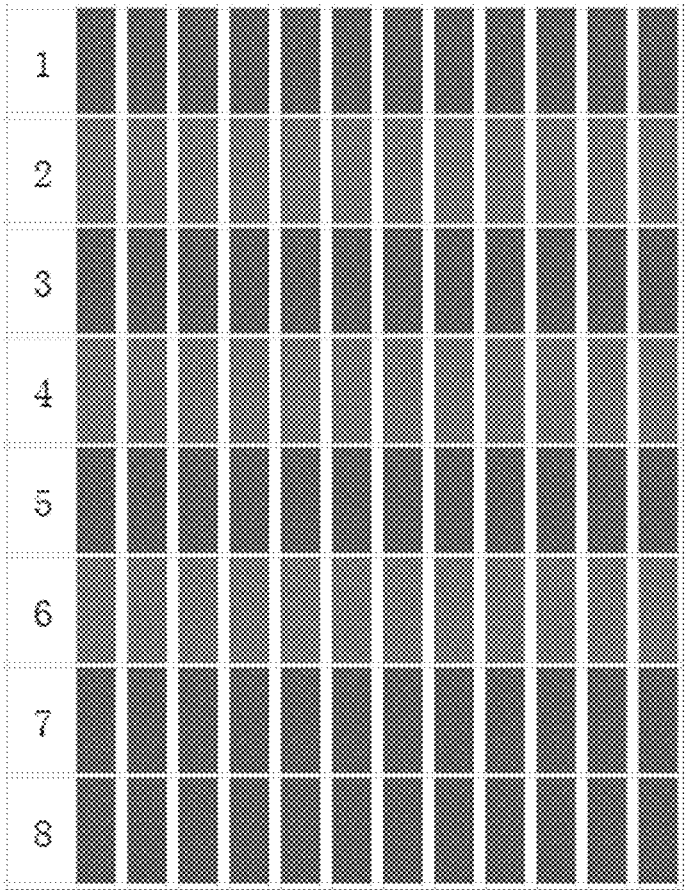
FIG. 3 illustrates a schematic diagram of a vertical line defect condition.

In the GOA driving circuit 100 shown in FIG. 1, ideally, driving voltages for the odd-numbered rows and the even-numbered rows should be the same, so that the same brightness for the odd-numbered rows and even-numbered rows can be generated after the same driving time elapses. However, the odd-numbered rows of shift registers and the even-numbered rows of shift registers are located on both sides of the panel. Due to the difference in resistances of fan-out areas of panels and the difference in process characteristics of the panels, it is easy to cause a difference in charging voltages of the odd-numbered rows and the even-numbered rows, and thereby a vertical line defect phenomenon due to the difference in brightness of the odd-numbered rows and the even-numbered rows occurs on the panel. FIG. 3 illustrates a schematic diagram of a vertical line defect condition. As can be seen from FIG. 3, odd-numbered rows are dark and even-numbered rows are bright. From the perspective of the driving principle of the thin film transistor, it is assumed that a driving voltage of liquid crystal is 4.2V, and if the odd-numbered rows and the even-numbered rows may both be charged to 4.2V, the brightness for the odd-numbered rows is the same as the brightness for the even-numbered rows. If the charging voltages for the odd-numbered rows and the even-numbered rows are different, for example, the charging voltage for the odd-numbered rows is 4.0V and the charging voltage for the even-numbered rows is 4.2V, the display effect shown in FIG. 3 may occur.

In order to solve this vertical line defect phenomenon, the embodiments of the present application further provide a level conversion circuit for a gate driving circuit of a display panel. The level conversion circuit comprises a level conversion sub-circuit, a power supply switch sub-circuit and a controller. The level conversion sub-circuit is configured to receive a first signal from the outside, receive a first driving level from the power supply switch sub-circuit, convert the received first signal into the first driving level which is greater than a voltage of the first signal, and output the first driving level to the gate driving circuit as a driving signal of the gate driving circuit. The power supply switch sub-circuit is configured to receive N candidate first levels from the outside, receive a control signal from the controller, select one of the N candidate first levels as the first driving level according to the received control signal, and output the selected first level to the level conversion sub-circuit, where N is an integer greater than or equal to 2.

In an embodiment, rows of pixels of the display panel may be divided into a plurality of groups. Each row of pixels corresponds to a shift register. Each group of rows of pixels corresponds to a level conversion sub-circuit and a power supply switch sub-circuit, and the controller outputs control signals which are independent of each other to power supply switch sub-circuits corresponding to different groups of rows of pixels respectively according to grouping of rows of pixels, so that the power supply switch sub-circuits output first driving levels which are independent of each other (and/or second driving levels which are independent of each other mentioned below). As used herein, the term "signals/voltages/levels which are independent of each other" means that amplitudes of multiple (for example, two) signals/voltages/levels are provided independently of each another, i.e., the signals/voltages/levels may have the same amplitude, or may have different amplitudes. For example, a magnitude of a driving voltage provided for one row of pixels may be different from or the same as a magnitude of a driving voltage provided for another row of pixels. In some embodiments, the amplitude may vary according to a thin film transistor to which a corresponding row of pixels is connected.

For convenience of description, a structure of the level conversion circuit according to the above embodiments will be described below by taking a case where a number of level conversion sub-circuits is 2 and N is equal to 2 as an example. Those skilled in the art can also understand from the following description how to realize an implementation of the level conversion circuit when the number of the level conversion sub-circuits is equal to 1 or greater than 2 and/or N is greater than 2.

Figure 4:
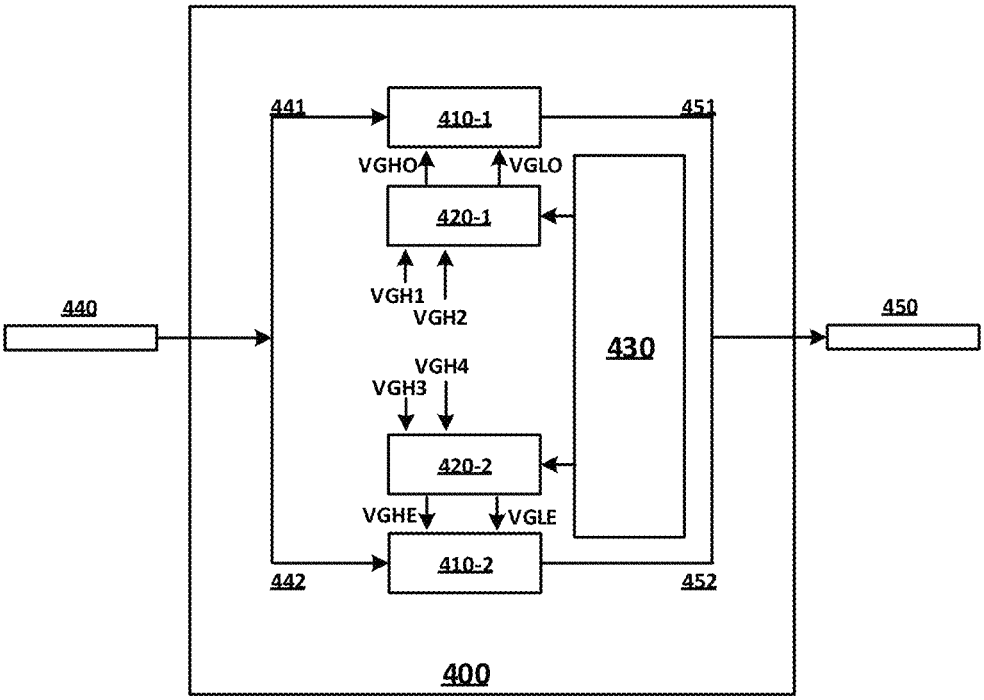
FIG. 4 illustrates a circuit diagram of a level conversion circuit according to an embodiment of the present disclosure.

FIG. 4 illustrates a circuit diagram of a level conversion circuit 400 having two candidate first level input terminals and two candidate second level input terminals according to an embodiment of the present disclosure. The level conversion circuit 400 may be applied to FIG. 1 as a level conversion circuit. The level conversion circuit 400 comprises two level conversion sub-circuits 410-1 and 410-2, two power supply switch sub-circuits 420-1 and 420-2, and a controller 430.

The level conversion sub-circuits 410-1 and 410-2 are configured to convert a first signal 441 (for example, STV1, CLK1, and CLKB1 in FIG. 1) for odd-numbered rows and a first signal 442 (for example, STV2, CLK2, and CLKB2 in FIG. 1) for even-numbered rows into a gate driving level 450 of a gate driving circuit respectively. The first signals 441 and 442 are sub-signals into which the input first signal 440 are separated according to the odd-numbered rows and the even-numbered rows; however, the present disclosure is not limited to separating the first signal according to the odd-numbered rows and the even-numbered rows, and instead, the first signal 440 may be separated into a plurality of sub-signals in any desired manner. The level conversion sub-circuit 410-1 has a first terminal configured to receive the input first signal 441 for the odd-numbered rows, a first level input terminal configured to receive a first driving level VGHO, a second level input terminal configured to receive a second driving level VGLO, and an output terminal configured to output an output level 451 to a signal input terminal of the gate driving circuit. The output level 451 is equal to VGHO or VGLO depending on whether the input first signal 441 is at a high level or a low level. Similarly, the level conversion sub-circuit 410-2 has a first input terminal configured to receive the input first signal 442 for the even-numbered rows, a first level input terminal configured to receive a first driving level VGHE, a second level input terminal configured to receive a second driving level VGLE, and an output terminal configured to output an output level 452 to the signal input terminal of the gate driving circuit. The output signal 452 is equal to VGHE or VGLE depending on whether the input first signal 442 is at a high level or a low level. In an embodiment, each of the level conversion sub-circuits 410-1 and 410-2 may be implemented as the circuit structure as shown in FIG. 9. In another embodiment, each of the level conversion sub-circuits 410-1 and 410-2 may be implemented as an operational amplifier, such as a "rail-to-rail operational amplifier."

Although the level conversion sub-circuit (410-1 or 410-2) is described in the embodiment of FIG. 4 as receiving both the first driving level and the second driving level, it should be understood that in other embodiments, the level conversion sub-circuit may only receive the first driving level. Thus, the level conversion sub-circuit converts the received first signal 440 into the first driving level, and outputs the first driving level to the gate driving circuit as a driving signal 450 of the gate driving circuit.

In an embodiment, the first driving levels VGHO and VGHE are higher than the high level of the first signal 440.

The power supply switch sub-circuits 420-1 and 420-2 correspond to the level conversion sub-circuits 410-1 and 410-2 respectively. The power supply switch sub-circuits 420-1 and 420-2 each comprise two candidate first level input terminals configured to receive two candidate first levels respectively. Specifically, the power supply switch sub-circuit 420-1 receives high levels VGH1 and VGH2; and the power supply switch sub-circuit 420-2 receives high levels VGH3 and VGH4.

In an embodiment, VGH3 may be equal to VGH1, and VGH4 may be equal to VGH2.

The power supply switch sub-circuits 420-1 and 420-2 each further comprise a control signal input terminal configured to receive a control signal from the controller 430.

The power supply switch sub-circuits 420-1 and 420-2 each further comprise a first level output terminal and a second level output terminal. In the power supply switch sub-circuit 420-1, the first level output terminal outputs the first driving level VGHO, and the second level output terminal outputs the second driving level VGLO. In an embodiment, the power supply switch sub-circuit 420-1 outputs an output level equal to one of the high levels VGH1 and VGH2 as the first driving level VGHO under the control of the control signal. The second driving level VGLO is directly generated by the first power supply switch sub-circuit 420-1 or received from the outside. In an embodiment, the level conversion sub-circuit 420-1 receives the second driving level VGLO directly from the outside.

Similarly, in the power supply switch sub-circuit 420-2, the first level output terminal outputs the first driving level VGHE, and the second level output terminal outputs the second driving level VGLE. In an embodiment, the power supply switch sub-circuit 420-2 outputs an output level equal to one of the high levels VGH3 and VGH4 as the first driving level VGHE under the control of the control signal. The second driving level VGLE is directly generated by the second power supply switch sub-circuit 420-2 or received from the outside. In an embodiment, the level conversion sub-circuit receives the second driving level VGLE directly from the outside.

The controller 430 outputs a control signal to the power supply switch sub-circuits 420-1 and 420-2. In an embodiment, the control signal is generated based on the actual gate driving voltage for pixel thin film transistors in each group of rows of pixels (odd-numbered rows and even-numbered rows). For example, when an actual gate driving voltage for the odd-numbered rows is lower than an actual gate driving voltage for the even-numbered rows, the control signal causes the power supply switch sub-circuit 420-1 to output an output level equal to one of VGH1 and VGH2 which has a higher level, and/or causes the power supply switch sub-circuit 420-2 to output an output level equal to one of VGH3 and VGH4 which has a lower level. Conversely, when the actual gate driving voltage for the odd-numbered rows is higher than the actual gate driving voltage for the even-numbered rows, the control signal causes the power supply switch sub-circuit 420-1 to output an output equal to one of VGH1 and VGH2 which has a lower level, and/or causes the power supply switch sub-circuit 420-2 to output an output level equal to one of VGH3 and VGH4 which has a higher level.

In an embodiment, when brightness of the odd-numbered rows is lower than brightness of the even-numbered rows, the controller 430 judges that the actual gate driving voltage for the odd-numbered rows is lower than the actual gate driving voltage for the even-numbered rows. Thus, it needs to increase the gate driving voltage for the odd-numbered rows by increasing VGHO and/or reduce the gate driving voltage for the even-numbered rows by reducing VGHE.

The structure of the power supply switch sub-circuits 420-1 and 420-2 will be described in more detail below. The following description is made with reference to FIG. 5 by taking the power supply switch sub-circuit 420-1 as an example, and those skilled in the art can realize the power supply switch sub-circuit 420-2 from the following description. It should be illustrated that the following description is made by taking transistors being N-type transistors as an example, and those skilled in the art should understand that P-type transistors are equally applicable here.

Figure 5:
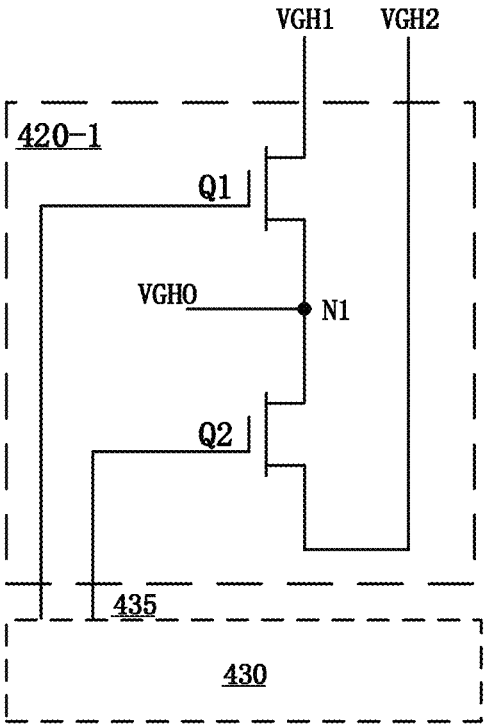
FIG. 5 illustrates a circuit diagram of a power supply switch sub-circuit in the level conversion circuit shown in FIG. 4.

In FIG. 5, the power supply switch sub-circuit 420-1 comprises two first transistors Q1 and Q2. The first transistors Q1 and Q2 have sources connected to the first level input terminals VGH1 and VGH2 respectively, drains both connected to the first level output terminal VGHO, and gates configured to receive the control signal 435 from the controller 430 respectively.

In an embodiment, the controller 430 controls turn-on and turn-off of the transistors Q1 and Q2 by applying a high level or a low level to the gates of the first transistors Q1 and Q2. The controller 430 controls one of the transistors Q1 and Q2 to be turned on and controls the other not to be turned on at a time.

For example, when the controller 430 applies a high level to Q1 and applies a low level to Q2, the transistor Q1 is turned on. At this time, a voltage at point N1 is VGH1. Thus, the output VGHO is equal to VGH1.

Similarly, when the controller 430 applies a low level to Q1 and applies a high level to Q2, the transistor Q2 is turned on. At this time, the voltage at the point N1 is VGH2. Thus, the output VGHO is equal to VGH2.

The embodiments of the present disclosure have been described above with reference to FIGS. 4 and 5 by taking a case where a number of the level conversion sub-circuits is equal to 2 and N is equal to 2 as an example. In the present embodiment, only the selection for the high level VGH is provided. However, in the practical production process, the difference between VGH and VGL for the same row of pixels needs to be maintained within a certain range. Therefore, when a current VGH is greatly different from a previous VGH after VGH is selected in the above embodiment, VGL of the row of pixels should also be modified accordingly so as to maintain the difference therebetween within a required range. In an embodiment, each power supply switch sub-circuit further comprises N candidate second level input terminals and a second level output terminal. The N candidate second level input terminals are configured to receive N candidate second levels respectively, and the second level output terminal is configured to output one of the N candidate second levels as the second driving level based on the control signal.

In addition, in the above embodiment, the controller 430 may be implemented as dedicated hardware such as an Application Specific Integrated Circuit (ASIC), a Field Programmable Gate Array (FPGA), a Programmable Logic Device (PLD), etc., or may be implemented as a combination of general purpose hardware and software and/or firmware, such as a combination of a microprocessor (for example, a Central Processing Unit (CPU), a Digital Signal Processor (DSP), etc.), a microcontroller (for example, a Microcontroller Unit (MCU), etc.) and software and/or firmware, which is not specifically limited in the present disclosure.

Further, in another embodiment, the N candidate second level input terminals are in a one-to-one correspondence with the N candidate first level input terminals. When one of the N candidate first levels is output as the first driving level based on the control signal, the output second driving level is a candidate second level which corresponds to the output candidate first level.

This embodiment will be described in more detail below with reference to FIGS. 6 and 7. Also, following embodiment will be described by taking the case where the number of the level conversion sub-circuits is 2 and N is equal to 2 as an example. Those skilled in the art can also understand from the following description how to realize an implementation of the level conversion circuit when the number of the level conversion sub-circuits is equal to 1 or greater than 2 and/or N is greater than 2.

Figure 6:
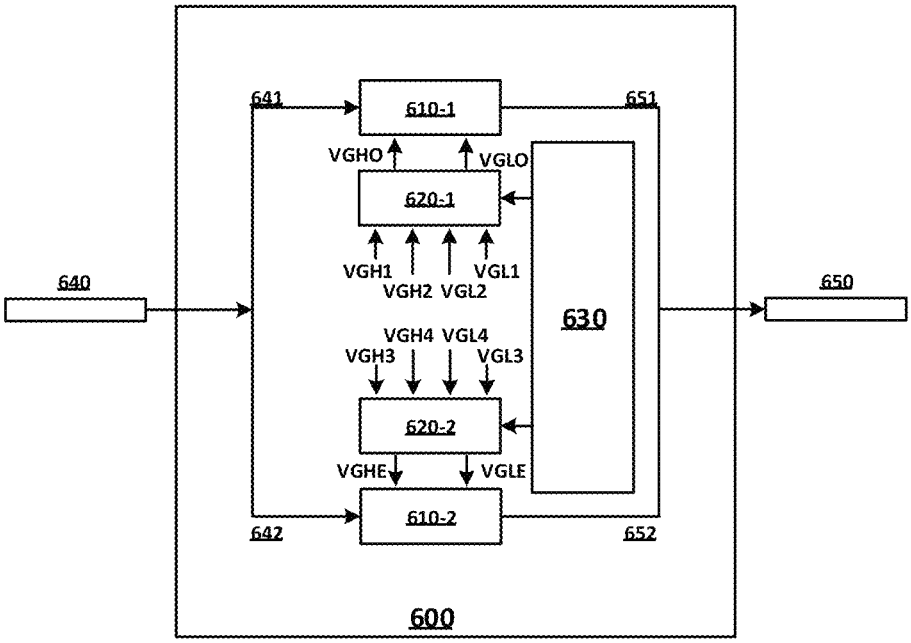
FIG. 6 illustrates a circuit diagram of a level conversion circuit according to another embodiment of the present disclosure.

FIG. 6 illustrates a circuit diagram of a level conversion circuit 600 having two candidate first level input terminals and two candidate second level input terminals according to another embodiment of the present disclosure. The level conversion circuit 600 may also be applied to FIG. 1 as a level conversion circuit. The level conversion circuit 600 comprises two level conversion sub-circuits 610-1 and 610-2, two power supply switch sub-circuits 620-1 and 620-2, and a controller 630.

The level conversion sub-circuits 610-1 and 610-2 are configured to convert a first signal 641 (for example, STV1, CLK1, and CLKB1 in FIG. 1) for odd-numbered rows and a first signal 642 (for example, STV2, CLK2, and CLKB2 in FIG. 1) for even-numbered rows into a gate driving level 650 of a gate driving circuit respectively. The first signals 641 and 642 are sub-signals into which the input first signal 640 are separated according to the odd-numbered rows and the even-numbered rows; however, the present disclosure is not limited to separating the first signal according to the odd-numbered rows and the even-numbered rows, and instead, the first signal 640 may be separated into a plurality of sub-signals in any desired manner. The level conversion sub-circuit 610-1 has a first terminal configured to receive the input first signal 641 for the odd-numbered rows, a first level input terminal configured to receive a first driving level VGHO, a second level input terminal configured to receive a second driving level VGLO, and an output terminal configured to output an output level 651 to a signal input terminal of the gate driving circuit. The output level 651 is equal to VGHO or VGLO depending on whether the input first signal 641 is at a high level or a low level. Similarly, the level conversion sub-circuit 610-2 has a first input terminal configured to receive the input first signal 642 for the even-numbered rows, a first level input terminal configured to receive a first driving level VGHE, a second level input terminal configured to receive a second driving level VGLE, and an output terminal configured to output an output level 652 to the signal input terminal of the gate driving circuit. The output level 652 is equal to VGHE or VGLE depending on whether the input first signal 642 is at a high level or a low level. In an embodiment, each of the level conversion sub-circuits 610-1 and 610-2 may be implemented as the circuit structure as shown in FIG. 9. In another embodiment, each of the level conversion sub-circuits 610-1 and 610-2 may be implemented as an operational amplifier, such as a "rail-to-rail operational amplifier."

Although the level conversion sub-circuit (610-1 or 610-2) is described in the embodiment of FIG. 6 as receiving both the first driving level and the second driving level, it should be understood that in other embodiments, the level conversion sub-circuit may only receive the first driving level. Thus, the level conversion sub-circuit converts the received first signal 640 into the first driving level, and outputs the first driving level to the gate driving circuit as a driving signal 650 of the gate driving circuit.

The power supply switch sub-circuits 620-1 and 620-2 correspond to the level conversion sub-circuits 610-1 and 610-2 respectively. The power supply switch sub-circuits 620-1 and 620-2 each comprise two candidate first level input terminals and two candidate second level input terminals configured to receive two candidate first levels and two candidate second levels respectively. Specifically, the power supply switch sub-circuit 620-1 receives high levels VGH1 and VGH2 and low levels VGL1 and VGL2; and the power supply switch sub-circuit 620-2 receives high levels VGH3 and VGH4 and low levels VGL3 and VGL4.

In an embodiment, VGH3 may be equal to VGH1, VGL3 may be equal to VGL1, VGH4 may be equal to VGH2, and VGL4 may be equal to VGL2.

The power supply switch sub-circuits 620-1 and 620-2 each further comprise a control signal input terminal configured to receive a control signal from the controller 630.

The power supply switch sub-circuits 620-1 and 620-2 each further comprise a first level output terminal and a second level output terminal. In the power supply switch sub-circuit 620-1, the first level output terminal outputs the first driving level VGHO, and the second level output terminal outputs the second driving level VGLO. Specifically, the power supply switch sub-circuit 620-1 outputs an output level equal to one of the high levels VGH1 and VGH2 and an output level equal to one of the low levels VGL1 and VGL2 as the first driving level VGHO and the second driving level VGLO respectively under the control of the control signal. In an embodiment, the level conversion sub-circuit 620-1 outputs a group of output levels equal to one of (VGH1 and VGL1) and (VGH2 and VGL2) as the first driving level VGHO and the second driving level VGLO under the control of the control signal.

Similarly, in the power supply switch sub-circuit 620-2, the first level output terminal outputs an output level equal to the first driving level VGHE, and the second level output terminal outputs a driving level equal to the second driving level VGLE. Specifically, the power supply switch sub-circuit 620-2 outputs an output level equal to one of the high levels VGH3 and VGH4 and an output level equal to one of the low levels VGL3 and VGL4 as the first driving level VGHE and the second driving level VGLE respectively under the control of the control signal. In an embodiment, the level conversion sub-circuit 620-2 outputs a group of output levels equal to one of (VGH3 and VGL3) and (VGH4 and VGL4) as the first driving level VGHE and the second driving level VGLE under the control of the control signal.

The controller 630 outputs a control signal to the power supply switch sub-circuits 620-1 and 620-2. In an embodiment, the control signal is generated based on the actual gate driving voltage for pixel thin film transistors in each group of rows of pixels (odd-numbered rows and even-numbered rows). For example, when an actual gate driving voltage for the odd-numbered rows is lower than an actual gate driving voltage for the even-numbered rows, the control signal may cause the power supply switch sub-circuit 620-1 to output an output level equal to one of VGH1 and VGH2 which has a higher level and output an output level equal to a corresponding one of VGL1 and VGL2, and/or cause the power supply switch sub-circuit 620-2 to output an output level equal to one of VGH3 and VGH4 which has a lower level and output an output level equal to a corresponding one of VGL3 and VGL4. Conversely, when the actual gate driving voltage for the odd-numbered rows is higher than the actual gate driving voltage for the even-numbered rows, the control signal may cause the power supply switch sub-circuit 620-1 to output an output equal to one of VGH1 and VGH2 which has a lower level and output an output level equal to a corresponding one of VGL1 and VGL2, and/or cause the power supply switch sub-circuit 620-2 to output an output level equal to one of VGH3 and VGH4 which has a higher level and output an output level equal to a corresponding one of VGL3 and VGL4.

In an embodiment, VGH1-VGH4 are in a one-to-one correspondence with VGL1-VGL4. In this case, when an output level equal to one of VGH1-VGH4 is output as the first driving level, a low level corresponding to the output high level is used as the second driving level. Thus, it can be ensured that a voltage difference between the first driving level and the second driving level is constant.

In an embodiment, when brightness of the odd-numbered rows is lower than brightness of the even-numbered rows, the controller 630 judges that the actual gate driving voltage for the odd-numbered rows is lower than the actual gate driving voltage for the even-numbered rows. Thus, it needs to increase the gate driving voltage for the odd-numbered rows by increasing VGHO and/or reduce the gate driving voltage for the even-numbered rows by reducing VGHE.

The structure of the power supply switch sub-circuits 620-1 and 620-2 will be described in more detail below. The following description is made with reference to FIG. 7 by taking the power supply switch sub-circuit 620-1 as an example, and those skilled in the art can realize the power supply switch sub-circuit 620-2 from the following description.

Figure 7:
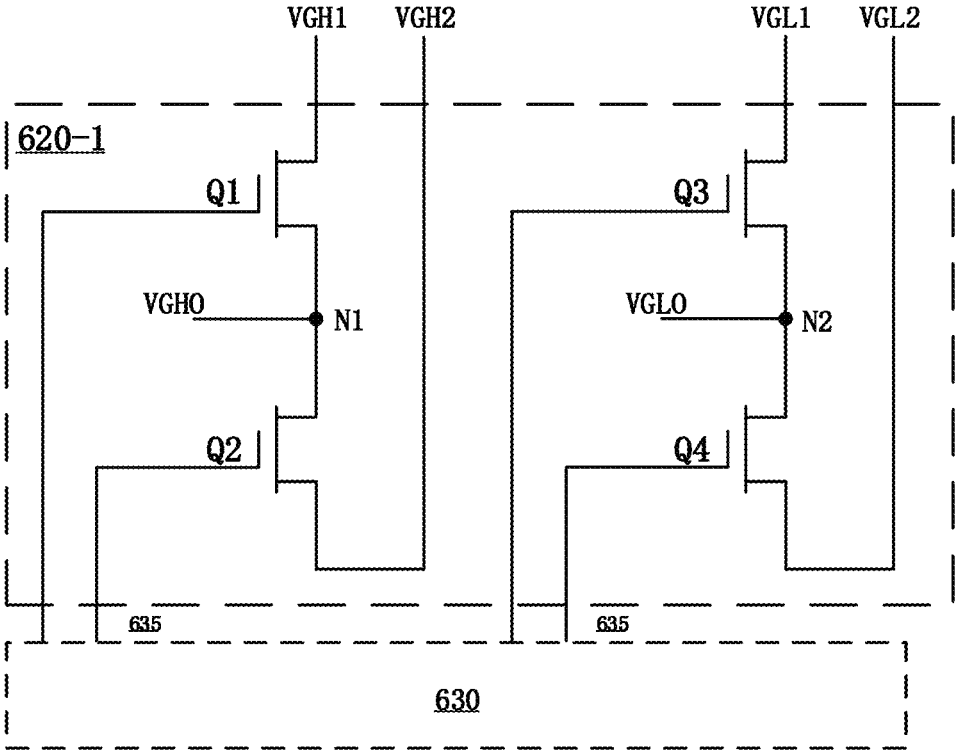
FIG. 7 illustrates a circuit diagram of a power supply switch sub-circuit in the level conversion circuit shown in FIG. 6.

In FIG. 7, the power supply switch sub-circuit 620-1 comprises two first transistors Q1 and Q2 and two second transistors Q3 and Q4. The first transistors Q1 and Q2 have sources connected to the first level input terminals VGH1 and VGH2 respectively, drains both connected to the first level output terminal VGHO, and gates configured to receive the control signal 635 from the controller 630 respectively. Similarly, the second transistors Q3 and Q4 have sources connected to the second level input terminals VGL1 and VGL2 respectively, drains both connected to the second level output terminal VGLO, and gates configured to receive the control signal 635 from the controller 630 respectively.

In an embodiment, the controller 630 controls turn-on and turn-off of the transistors Q1-Q4 by applying a high level or a low level to the gates of the first transistors Q1-Q4. The controller 630 controls one of the transistors Q1 and Q2 to be turned on and controls one of Q3 and Q4 to be turned on at a time.

For example, when the controller 630 applies a high level to Q1 and Q3 and applies a low level to Q2 and Q4, the transistors Q1 and Q3 are turned on respectively. At this time, a voltage at the point N1 is VGH1, and a voltage at point N2 is VGL1. Thus, the output VGHO is equal to VGH1, and the output VGLO is equal to VGL1.

Similarly, when the controller 630 applies a low level to Q1 and Q3 and applies a high level to Q2 and Q4, the transistors Q2 and Q4 are turned on respectively. At this time, the voltage at the point N1 is VGH2, and the voltage at the point N2 is VGL2. Thus, the output VGHO is equal to VGH2, and the output VGLO is equal to VGL2.

Figure 8:
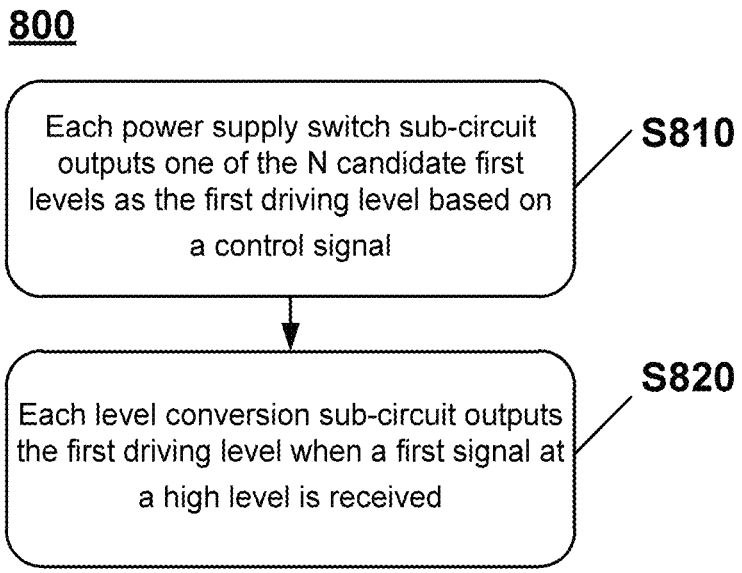
FIG. 8 illustrates a flowchart of a method for driving a level conversion circuit according to an embodiment of the present disclosure.

FIG. 8 illustrates a flowchart of a method 800 for driving a level conversion circuit according to an embodiment of the present disclosure. The method 800 starts in step S810, in which each power supply switch sub-circuit outputs an output level equal to one of the N candidate first levels as the first driving level based on a control signal. Then, in step S820, each level conversion sub-circuit outputs an output level equal to the first driving level when a first signal at a high level is received.

In an embodiment, the method 800 further comprises: outputting, by each power supply switch sub-circuit, one of the N candidate second levels as the second driving level based on the control signal; and outputting, by each level conversion sub-circuit, the second driving level when the first signal at a low level is received.

In an embodiment, the method 800 further comprises: generating an updated control signal according to an actual gate driving voltage of a pixel thin film transistor; and switching the first driving level output by the power supply switch sub-circuit (or one or more of a plurality of power supply switch sub-circuits) into another candidate first level according to the updated control signal.

In an embodiment, the method 800 further comprises: switching the second driving level output by the power supply switch sub-circuit (or one or more of a plurality of power supply switch sub-circuits) into another candidate second level according to the updated control signal.

The level conversion circuit and the method for driving the same according to the present disclosure have been described in detail above. In addition, the present disclosure further proposes a display apparatus. The display apparatus comprises the level conversion circuit according to the above embodiments. Specifically, the display apparatus may be a liquid crystal display apparatus such as a liquid crystal panel, a liquid crystal television, a mobile phone, an electronic reader, a liquid crystal display, etc.

The purposes, technical solutions, and beneficial effects of the present disclosure have been further described in detail in the specific embodiments described above, and it should be understood that the above description is merely specific embodiments of the present disclosure and is not intended to limit the present disclosure. Any modification, equivalent substitution, improvement etc. made within the spirit and principle of the present disclosure shall fall within the protection scope of the present disclosure.

We claim:

1. A display apparatus, comprising:

a plurality of pixels;

a plurality of shift registers, each shift register being connected to at least one pixel and configured to provide a scanning signal to the at least one pixel; and a level conversion circuit connected to the plurality of shift registers, and configured to provide a first driving signal and a second driving signal, which are independent of each other, to a first shift register and a second shift register of the plurality of shift registers, respectively;

wherein the level conversion circuit comprises a level conversion sub-circuit, a power supply switch sub-circuit, and a controller;

wherein the level conversion sub-circuit is connected to the power supply switch sub-circuit and is configured to receive a first signal from a first input terminal of the level conversion circuit, receive a first driving level from the power supply switch sub-circuit, convert the received first signal into the first driving level, and output the first driving level to a corresponding shift register connected to the level conversion circuit through an output terminal of the level conversion circuit, wherein the power supply switch sub-circuit is further connected to the controller and is configured to receive N candidate first levels, receive a control signal from the controller, select one of the N candidate first levels as the first driving level according to the received control signal, and output the selected first driving level to the level conversion sub-circuit, where N is an integer greater than or equal to 2.

2. The display apparatus according to claim 1, wherein the plurality of pixels are divided into a plurality of groups of pixels by rows or columns, pixels in each group of pixels are connected to a same gate driving circuit, each gate driving circuit is formed by cascading at least one of the plurality of shift registers, and the first shift register and the second shift register belong to different gate driving circuits, respectively.

3. The display apparatus according to claim 2, wherein the plurality of pixels are divided into two groups by rows, which are a group of odd-numbered rows of pixels and a group of even-numbered rows of pixels, and the level conversion circuit is configured to provide driving signals, which are independent of each other, to the group of odd-numbered rows of pixels and the group of even-numbered rows of pixels, respectively.

4. The display apparatus according to claim 1, wherein the first driving signal and/or the second driving signal are frame start signals and/or clock control signals.

5. The display apparatus according to claim 1, wherein the level conversion sub-circuit is further configured to receive a second driving level from the power supply switch sub-circuit, convert the received first signal to a second driving level, and output the second driving level; and wherein the power supply switch sub-circuit is further configured to receive N candidate second levels, select one of the N candidate second levels as the second driving level according to the received control signal, and output the selected second driving level to the level conversion sub-circuit, wherein the first driving level is different from the second driving level.

6. The display apparatus according to claim 5, wherein the N candidate first levels are in a one-to-one correspondence with the N candidate second levels, and the power supply switch sub-circuit selects a candidate first level and a candidate second level, which correspond to each other, based on the control signal.

7. The display apparatus according to claim 1, wherein the power supply switch sub-circuit comprises N first transistors, each first transistor being connected to a candidate first level input terminal, wherein each first transistor has a source configured to input a corresponding candidate first level, a gate connected to the controller and controlled by the control signal, and a drain connected to the level conversion sub-circuit and configured to output the corresponding candidate first level to the level conversion sub-circuit as the first driving level when the first transistor is turned on.

8. The display apparatus according to claim 7, wherein the power supply switch sub-circuit comprises N second transistors, each second transistor corresponding to a candidate second level, wherein each second transistor has a source connected to a corresponding candidate second level, a gate connected to the controller and controlled by the control signal, and a drain connected to the level conversion sub-circuit and configured to output the corresponding candidate second level to the level conversion sub-circuit as the second driving level when the second transistor is turned on.

9. A level conversion circuit comprising a level conversion sub-circuit, a power supply switch sub-circuit, and a controller, wherein the level conversion sub-circuit is connected to a first input terminal, the power supply switch sub-circuit, and an output terminal, respectively, and is configured to receive a first signal from the first input terminal, receive a first driving level from the power supply switch sub-circuit, convert the received first signal into the first driving level, and output the first driving level to the output terminal; and wherein the power supply switch sub-circuit is further connected to the controller and is configured to receive N candidate first levels, receive a control signal from the controller, select one of the N candidate first levels as the first driving level according to the received control signal, and output the selected first driving level to the level conversion sub-circuit, where N is an integer greater than or equal to 2.

10. The level conversion circuit according to claim 9, wherein the power supply switch sub-circuit is further configured to receive N candidate second levels, select one of the N candidate second levels as the second driving level according to the received control signal and output the selected second driving level to the level conversion sub-circuit, wherein the first driving level is different from the second driving level.

11. A method for driving a level conversion circuit, the level conversion circuit comprising a level conversion sub-circuit, a power supply switch sub-circuit, and a controller, wherein the level conversion sub-circuit is connected to a first input terminal, the power supply switch sub-circuit, and an output terminal, respectively, and is configured to receive a first signal from the first input terminal, receive a first driving level from the power supply switch sub-circuit, convert the received first signal into the first driving level, and output the first driving level to the output terminal; and wherein the power supply switch sub-circuit is further connected to the controller and is configured to receive N candidate first levels, receive a control signal from the controller, select one of the N candidate first levels as the first driving level according to the received control signal, and output the selected first driving level to the level conversion sub-circuit, where N is an integer greater than or equal to 2, wherein the method comprises:

outputting, by the power supply switch sub-circuit, one of the N candidate first levels as the first driving level based on the control signal; and outputting, by the level conversion sub-circuit, an output level equal to the first driving level when the first signal at a high level is received.

12. The method according to claim 11, wherein the power supply switch sub-circuit of the level conversion circuit is further configured to receive N candidate second levels, select one of the N candidate second levels as the second driving level according to the received control signal, and output the selected second driving level to the level conversion sub-circuit, wherein the first driving level is different from the second driving level, the method further comprising:

outputting, by the power supply switch sub-circuit, one of the N candidate second levels as the second driving level based on the control signal; and outputting, by the level conversion sub-circuit, an output level equal to the second driving level when the first signal at a low level is received.

13. A method for driving a display apparatus, comprising:

providing a plurality of pixels;

providing a plurality of shift registers, each shift register being, connected to at least one pixel and configured to provide a scanning signal to the at least one pixel;

providing a level conversion circuit connected to the plurality of shift registers, and configured to provide a first driving signal and a second driving signal, which are independent of each other, to a first shift register and a second shift register of the plurality of shift registers, respectively;

generating a control signal according to an actual gate driving voltage of a thin film transistor which controls switching of a pixel; and generating, by the level conversion circuit, driving signals corresponding to a plurality of shift registers, respectively, according to the control signal, wherein a first driving signal and a second driving signal corresponding to a first shift register and a second shift register of the plurality of shift registers, respectively, are independent of each other, wherein the level conversion circuit comprises a level conversion sub-circuit, a power supply switch sub-circuit, and a controller, wherein the level conversion sub-circuit is connected to the power supply switch sub-circuit and is configured to receive a first signal from a first input terminal of the level conversion circuit, receive a first driving level from the power supply switch sub-circuit, convert the received first, signal into the first driving level, and output the first driving level to a corresponding shift register connected to the level conversion circuit through an output terminal of the level conversion circuit; and wherein the power supply switch sub-circuit is further connected to the controller and is configured to receive N candidate first levels, receive a control signal from the controller, select one of the candidate first levels as the first driving level according to the received control signal, and output the selected first driving level to the level conversion sub-circuit, where N is an integer greater than or equal to 2.

14. The method according to claim 13, wherein generating, by the level conversion circuit, driving signals corresponding to a plurality of shift registers, respectively, according to the control signal comprises:

switching the first driving level output by the power supply switch sub-circuit of the level conversion circuit to a candidate first level corresponding to the actual gate driving voltage according to the control signal; and outputting, by the level conversion sub-circuit of the level conversion circuit, the candidate first level as a driving signal for driving a corresponding shift register.

15. The method according to claim 13, wherein generating, by the level conversion circuit, driving signals corresponding to a plurality of shift registers, respectively, according to the control signal comprises:

switching the second driving level output by the power supply switch sub-circuit of the level conversion circuit to a candidate second level corresponding to the actual gate driving voltage according to the control signal; and outputting, by the level conversion sub-circuit of the level conversion circuit, the candidate second level as a driving signal for driving a corresponding shift register.

* * * * *